US006282970B1

(12) United States Patent
Oakley

(10) Patent No.: US 6,282,970 B1
(45) Date of Patent: Sep. 4, 2001

(54) LOCKING DRIVE NUT FOR SCREW DRIVE SYSTEMS

(75) Inventor: Robert L. Oakley, Chicago, IL (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/407,245

(22) Filed: Sep. 28, 1999

Related U.S. Application Data

(60) Provisional application No. 60/102,155, filed on Sep. 28, 1998.

(51) Int. Cl.[7] ..... E05F 11/34
(52) U.S. Cl. ..... 74/89.15; 49/362
(58) Field of Search ..... 74/89.15, 424.8 R; 49/362, 118

(56) References Cited

U.S. PATENT DOCUMENTS 3,459,058 * 8/1969 Fawkes ..... 74/89.15
3,575,378 * 4/1971 Fawkes ..... 74/89.15
4,075,898 * 2/1978 Carlson, Jr. ..... 74/89.15
4,091,570 * 5/1978 Favrel ..... 49/362 X
4,198,786 * 4/1980 Monot ..... 49/362
4,290,368 * 9/1981 Mazzini ..... 49/362 X
5,077,938 * 1/1992 Moreuil ..... 49/362
5,341,598 * 8/1994 Reddy ..... 74/89.15 X
5,758,453 * 6/1998 Inage ..... 49/118
6,009,668 * 1/2000 Reddy ..... 49/362
6,098,341 * 8/2000 Gebauer ..... 49/362 X
6,134,838 * 10/2000 Reddy ..... 49/362

* cited by examiner

*Primary Examiner*—David A. Bucci
*Assistant Examiner*—Colby Hansen
(74) *Attorney, Agent, or Firm*—James Ray & Associates

(57) ABSTRACT

A screw drive mechanism connectable to at least one of a first machine portion and a second machine portion for moving the second machine portion relative to the first machine portion from a first position to a second position. The mechanism has a base for attachment to one of the first and the second machine portions and a motor attached to the base. It includes a drive screw having a rotary motion connection to the motor to be rotated thereby and a drive nut having an internally threaded bore engaged with the drive screw to receive a drive force from the drive screw. A drive nut connection is engaged with the drive nut for conveying the drive force to one of the first and the second machine portions. An anti-rotation member is attached to the drive nut connection, the anti-rotation member engaging the drive nut to prevent rotation thereof. The mechanism also includes an activation member attached to the base, the activation member contacting a disengaging surface portion of the anti-rotation member when such one of the first and the second machine portions is moved to the second position to place the anti-rotation member in a position disengaged from the drive nut so that the drive nut may rotate. A drive nut rotating device is attached to the base, the drive nut rotating device rotating the drive nut to a locking position when such one of the first and the second machine portions is moved to the second position.

20 Claims, 8 Drawing Sheets

FIG.2
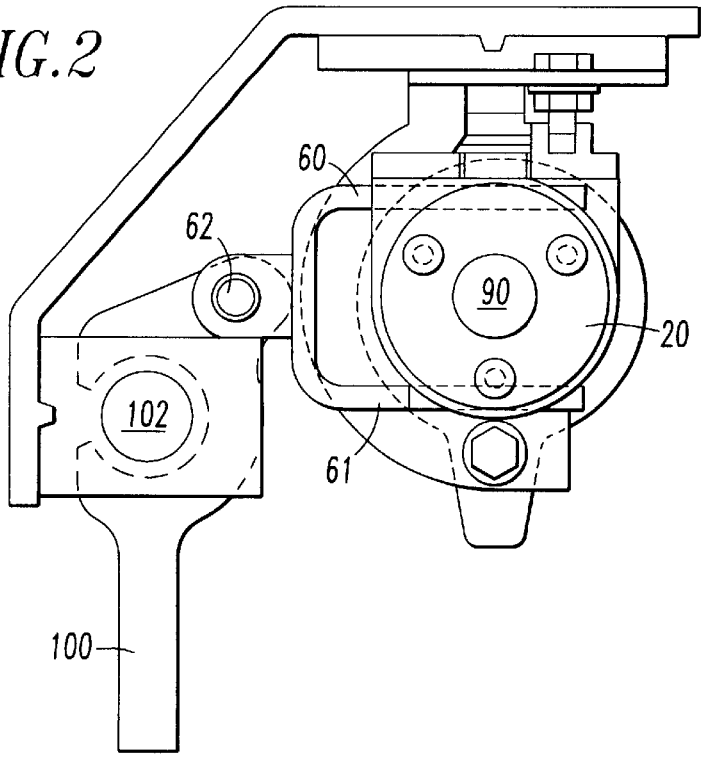
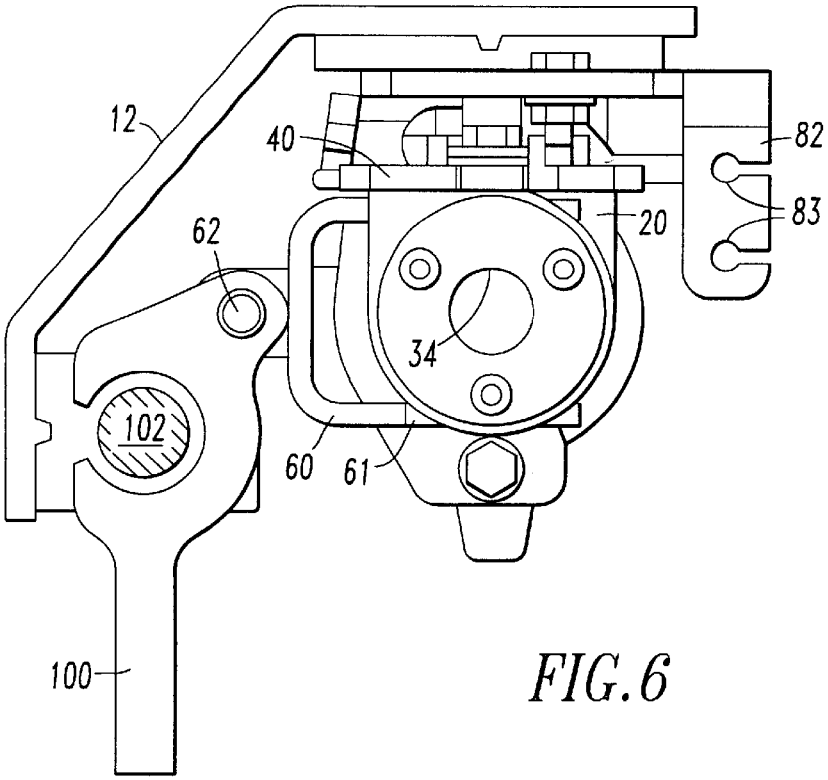
FIG.6

FIG. 3
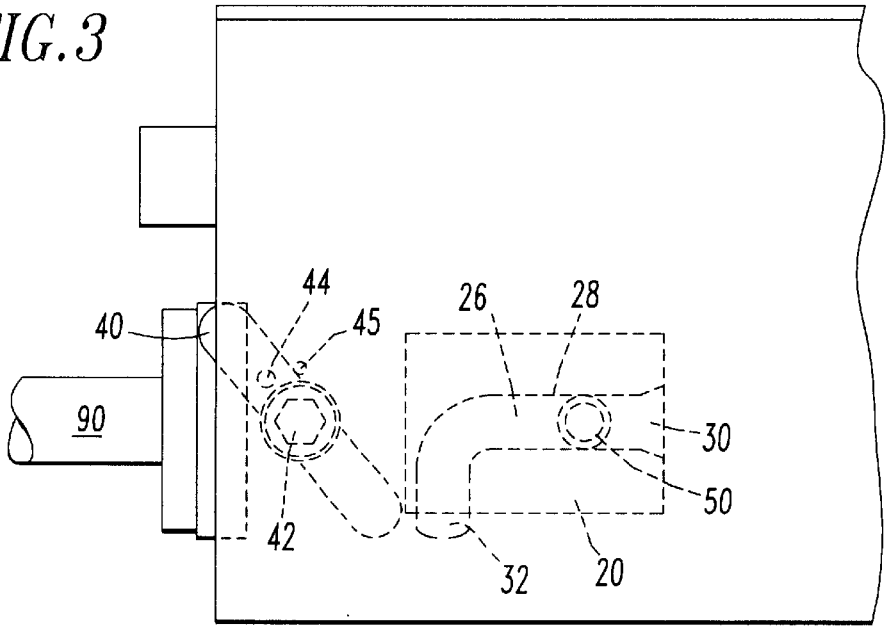
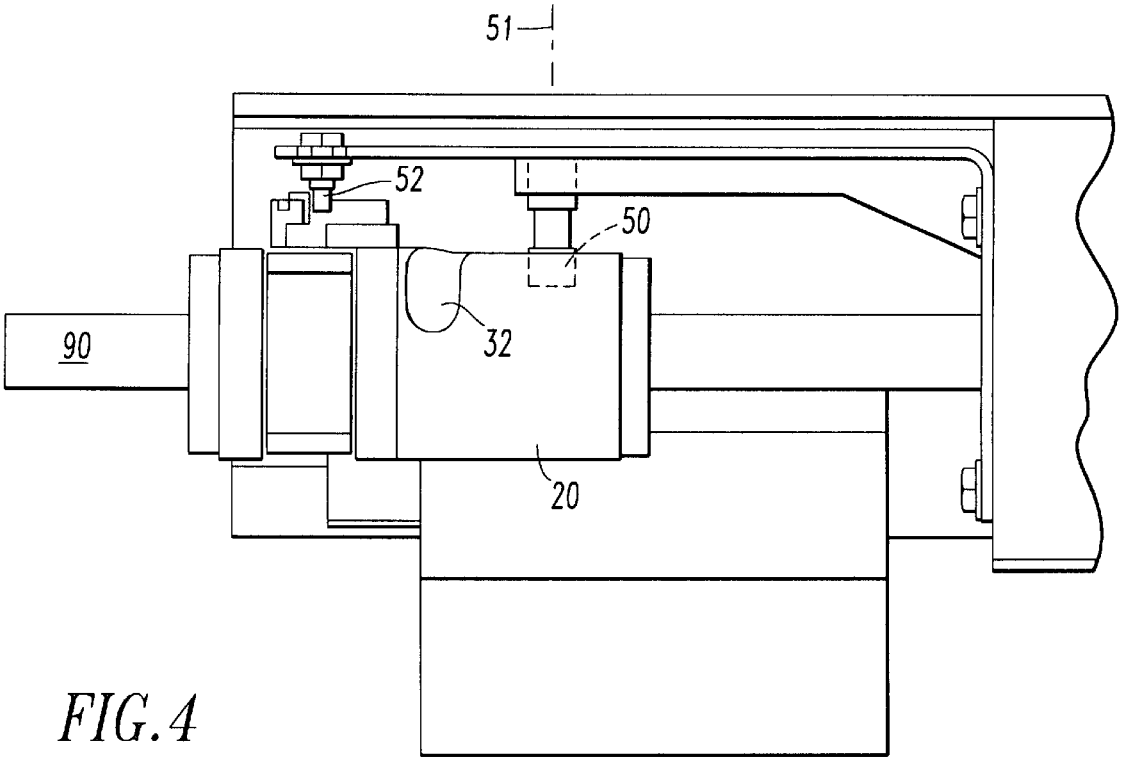
FIG. 4

LOCKING DRIVE NUT FOR SCREW DRIVE SYSTEMS

CROSS-REFERENCE TO RELATED APPLICATIONS

The invention described in this patent application is based on the provisional application Locking Drive Nut for Screw Drive Systems, Ser. No. 60/102,155, filed on Sep. 28, 1998.

In addition, the invention described in this patent application is closely related to the patent application Self Aligning Drive Nut Bracket, Ser. No. 09/150,421 U.S. Pat. No. 6,026,697 which was filed on Sep. 9, 1998, and patented Feb. 22, 2000. The referenced patent application has one inventor in common with the present application and is assigned to the assignee of the present application.

FIELD OF THE INVENTION

The present invention relates, in general, to screw drive mechanisms and, more particularly, this invention relates to a passenger transit type vehicle door system employing a screw drive mechanism.

BACKGROUND OF THE INVENTION

Drive systems for passenger transit type vehicle doors must meet a number of conflicting requirements, as is generally well known in the passenger transit industry. For example, these doors must open and close rather quickly and smoothly upon receipt of a control signal to open or close. Additionally, these doors must have a positive lock to prevent them from being inadvertently opened when the transit vehicle is in motion. On the other hand, such doors require a manual release to unlock and open them in the event of an emergency.

SUMMARY OF THE INVENTION

In one aspect, the present invention provides a screw drive mechanism connectable to a first machine portion and to a second machine portion for moving the second machine portion relative to the first machine portion from a first position to a second position. The mechanism includes a base for attachment to the first machine portion and a motor attached to the base. Additionally, the screw drive mechanism includes a drive screw having a rotary motion connection to the motor to be rotated thereby and a drive nut having an internally threaded bore engaged with the drive screw to receive a drive force from the drive screw. A drive nut connection is engaged with the drive nut for conveying the drive force to the second machine portion. An anti-rotation member is attached to the drive nut connection which engages the drive nut to prevent rotation of such drive nut. The drive screw mechanism also includes an activation member attached to the base. Such activation member contacts a disengaging surface portion of the anti-rotation member when the second machine portion is moved to the second position to place the anti-rotation member in a position disengaged from the drive nut so that the drive nut may rotate. A drive nut rotating device is attached to the base for rotating the drive nut to a locking position when the second machine portion is moved to the second position.

In another aspect, the invention provides a screw drive mechanism for a transit vehicle door for moving the door from an open position to a closed position. The screw drive mechanism includes a base for attachment to the transit vehicle and a motor attached to the base. It has a drive screw having a rotary motion connection to the motor to be rotated thereby and a drive nut having an internally threaded bore engaged with the drive screw to receive a drive force from the drive screw. A drive nut connection is engaged with the drive nut to convey the drive force to the door. An anti-rotation member is attached to the drive nut connection for engaging the drive nut to prevent rotation of such drive nut. An activation member is attached to the base which is in contact with a disengaging surface portion of the anti-rotation member when the door is moved to the closed position to place the anti-rotation member in a position disengaged from the drive nut so that the drive nut may rotate. The mechanism further includes a drive nut rotating device attached to the base. Such drive nut rotating device rotates the drive nut to a locking position when the door is moved to the closed position.

OBJECTS OF THE INVENTION

It is, therefore, one of the primary objects of the present invention to provide a passenger transit type vehicle door system having a motor and a door which is opened, closed and locked by the motor.

Another object of the present invention is to provide a passenger transit type vehicle door system having a door and a motor in which the door is locked when the motor moves it to a closed position.

Still another object of the present invention is to provide a passenger transit type vehicle door system having a manual release mechanism which can unlock the door and the system being back driveable to open the door upon activation of the manual release mechanism.

Yet another object of the present invention is to provide a passenger transit type vehicle door system which, when closed, cannot be reopened without an activation of a manual release mechanism.

A further object of the present invention is to provide a passenger transit type vehicle door system which has a first manual release for use by persons inside the vehicle and a second manual release for rescue personnel outside the vehicle.

An additional object of the present invention is to provide a passenger transit type vehicle door system which is moved to a locked position by a motor which opens and closes the door.

Yet a further object of the present invention is to provide a passenger transit type vehicle door system having a drive nut which is rotated to a locking position upon movement of the door to the closed position.

Still another object of the present invention is to provide a passenger transit type vehicle door system which can accommodate misalignment between a door support rod and a drive screw for the door.

It is another object of the present invention to provide a passenger transit type vehicle door lock in which a force on the door in the opening direction will force the locking components more firmly into the locked position.

It is yet another object of the present invention to provide a passenger transit type vehicle door lock in which compression of resilient seals at the edges of the door forces the locking components more firmly into the locked position.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

BRIEF DESCRIPTION OF THE DRAWINGS

FIG. 2 is an end view of the passenger transit type vehicle door drive illustrated in FIG. 1.

FIG. 3 is a top view of the passenger transit type vehicle door drive illustrated in FIGS. 1 and 2.

FIG. 4 is a front elevation view of the passenger transit type vehicle door drive illustrated in FIGS. 1–3.

FIG. 6 is an end view of the passenger transit type vehicle door drive which shows a cable sheath termination tab.

Figure 1:
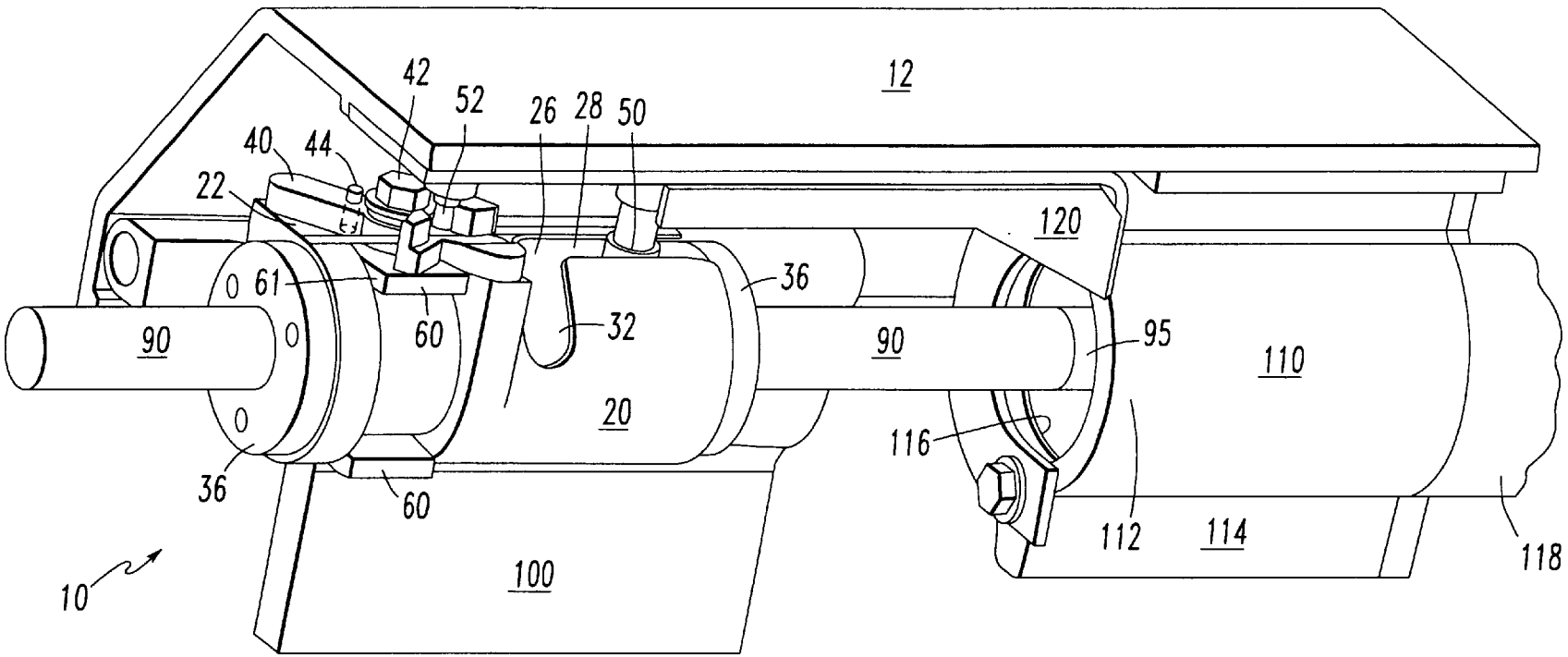
FIG. 1 is a perspective view illustrating one embodiment of a linear drive mechanism according to the present invention which is for a passenger transit vehicle door.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

Reference is now made, more particularly, to FIG. 1 of the drawings. Illustrated therein is a linear drive mechanism, generally designated 10. Such linear drive mechanism 10 is useful in machines having a first machine portion and a second machine portion and with the second machine portion being moved relatively to the first machine portion. The first machine portion, for example, may be a transit vehicle and the second machine portion may be a bridge plate or door of the transit vehicle. The second machine portion is moved substantially along a straight path to a locked position.

The specific embodiment shown is a door drive for a passenger transit type vehicle door system. It has a base 12 which is engageable with the first portion of the machine which, in the presently preferred embodiment, is the transit vehicle (not shown). The base 12 includes a motor mount 110 to which a motor 118 is attached. A spine 114 of such motor mount 110 facilitates the mounting of the motor 118.

Such door drive has a drive screw 90 which includes a rotary motion connection to the motor 118. Preferably, such rotary motion connection is a coupling 95 which is enclosed in motor mount 110. It is preferred that a bearing (not shown) be provided at bearing socket 116 located at the proximal end 112 of motor mount 110.

The mechanism 10 further includes a drive nut 20 which has a threaded bore 34 (shown in FIGS. 6 and 9) that engages the drive screw 90 to be moved thereby. Drive nut 20 is engaged by a drive force receiving member 60 (best seen in FIGS. 1, 2 and 6). In the presently preferred embodiment, drive force receiving member 60 is a fork which is pivoted about pivot 62. Drive force receiving member 60 has drive force receiving surfaces 61 which engage the drive nut 20.

In the presently preferred embodiment, such drive force receiving member 60 is pivotally attached to a door hanger 100 which is supported on a door suspension rod 102. The door (not shown) is attached to such door hanger 100.

An anti-rotation member, preferably an anti-rotation lever 40, is attached to a drive nut connection by pivot 42. Such anti-rotation lever 40 prevents rotation of drive nut 20. Drive nut 20 has at least one torsion surface portion 22 for engaging such anti-rotation lever 40 to prevent the rotation of such drive nut 20.

Figure 11:
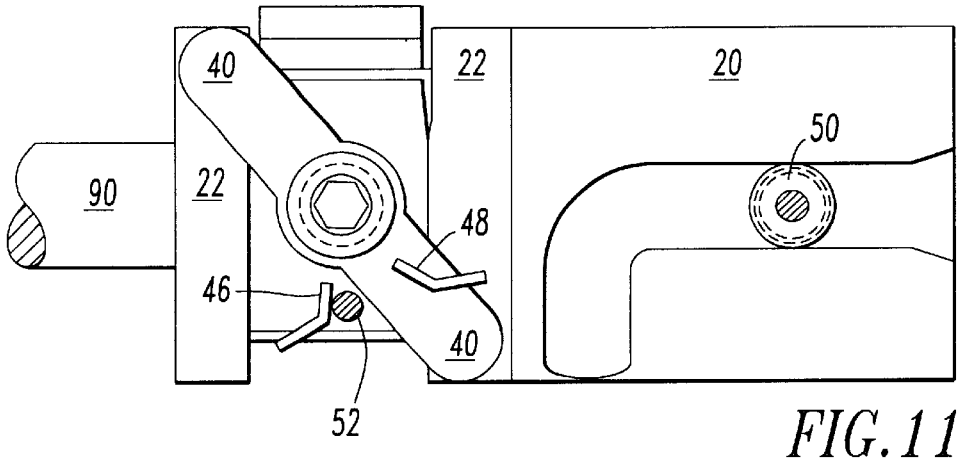
FIG. 11 is a top view showing the activation pin engaging a disengaging surface portion of the anti-rotation lever.

The mechanism 10 also includes an activation member, preferably an activation pin 52, which is preferably mounted on a cantilever 120. Such cantilever 120 forms a portion of base 12. The activation pin 52 contacts a disengaging surface portion 46, as best seen in FIG. 11, of anti-rotation lever 40 to disengage anti-rotation lever 40 from drive nut 20 so that such drive nut 20 may rotate.

A drive nut rotating device, preferably a lock roller 50 is mounted on such cantilever 120 of base 12. Lock roller 50 is free to rotate about an axis 51. In the presently preferred embodiment shown, the lock roller 50 engages a track 26. Track 26 has a flared end portion 30 to facilitate entry of a lock roller 50 into the track 26. Preferably, track 26 is a groove. Track 26 includes a substantially axial portion 28 and a substantially circumferential portion 32. It is presently preferred that the substantially circumferential portion 32 will have a small reverse lead which is indicated by angle 33, best seen in FIG. 9C. The engagement of lock roller 50 with track 26 causes rotation of drive nut 20 to a locking position.

Due to the retrograde angle 33 of such substantially circumferential portion 32 of track 26, any attempt to move the door to an open position causes the lock roller 50 to engage more firmly the substantially circumferential portion 32 of track 26 and thereby prevent opening of the door. In the presently preferred embodiment, retrograde angle 33 is generally about three degrees. When the invention is used for a passenger transit type vehicle door which has a resilient seal along the edge that is compressed when the door is closed, the seal exerts a force in the opening direction. Such force causes the lock roller 50 to engage more firmly the substantially circumferential portion 32 of track 26 and more firmly lock the door.

When the second machine portion, which in the presently preferred embodiment is a transit vehicle door (not shown), is moved out of the locked position such activation member (preferably activation pin 52) contacts engaging surface portion 48 (best seen in FIG. 10) of anti-rotation lever 40 so that drive nut 20 is prevented from rotating. When drive nut 20 is prevented from rotating the rotation of drive screw 90 causes the door to move to the open position.

FIG. 1 shows the door drive system with the door close to the locked position. When the door is open, drive nut 20 and door hanger 100 are displaced toward the left in FIG. 1. Also, when the door is open the drive nut 20 is prevented from rotating by anti-rotation lever 40 and furthermore when the door is open the anti-rotation lever 40 is in the position shown in FIG. 1. In this position, the anti-rotation lever 40 engages the torsion surface portions 22 of drive nut 20.

When the door is in the position shown in FIG. 1, the lock roller 50 and the anti-rotation lever 40 provide a redundant prevention of rotation of drive nut 20. When the drive nut 20 is moved further to the right in FIG. 1, the lock roller 50 enters the portion 32 of track 26 which is substantially circumferential. Also, the anti-rotation lever 40 is rotated by activation pin 52 to a position transverse to the drive screw 90, in which it does not prevent rotation of drive nut 20. As the lock roller 50 enters the circumferential track portion 32, the drive nut 20 is rotated so that lock roller 50 is in the circumferential track portion 32. In that position, the drive nut 20 is locked and the door is locked.

FIG. 2 is an end view of the presently preferred embodiment which shows the drive screw 90 that engages drive nut 20. A drive force exerted on drive nut 20 is communicated by a drive force receiving member 60 to a door hanger 100 through a pivot 62. Door hanger 100 is supported on a door suspension rod 102. Pivot 62 accommodates misalignment between such door suspension rod 102 and drive screw 90.

Additional detail is shown in FIG. 3, which is a top view. The system is configured with the drive nut 20 moved to a position in which the lock roller 50 has entered into the axial portion 28 of track 26. FIG. 4 shows the system in the same configuration as the preceding three figures and shows an activation pin 52 which moves the anti-rotation lever 40 between the position shown in these figures and figures shown subsequently in which it does not prevent rotation of drive nut 20.

Figure 5:
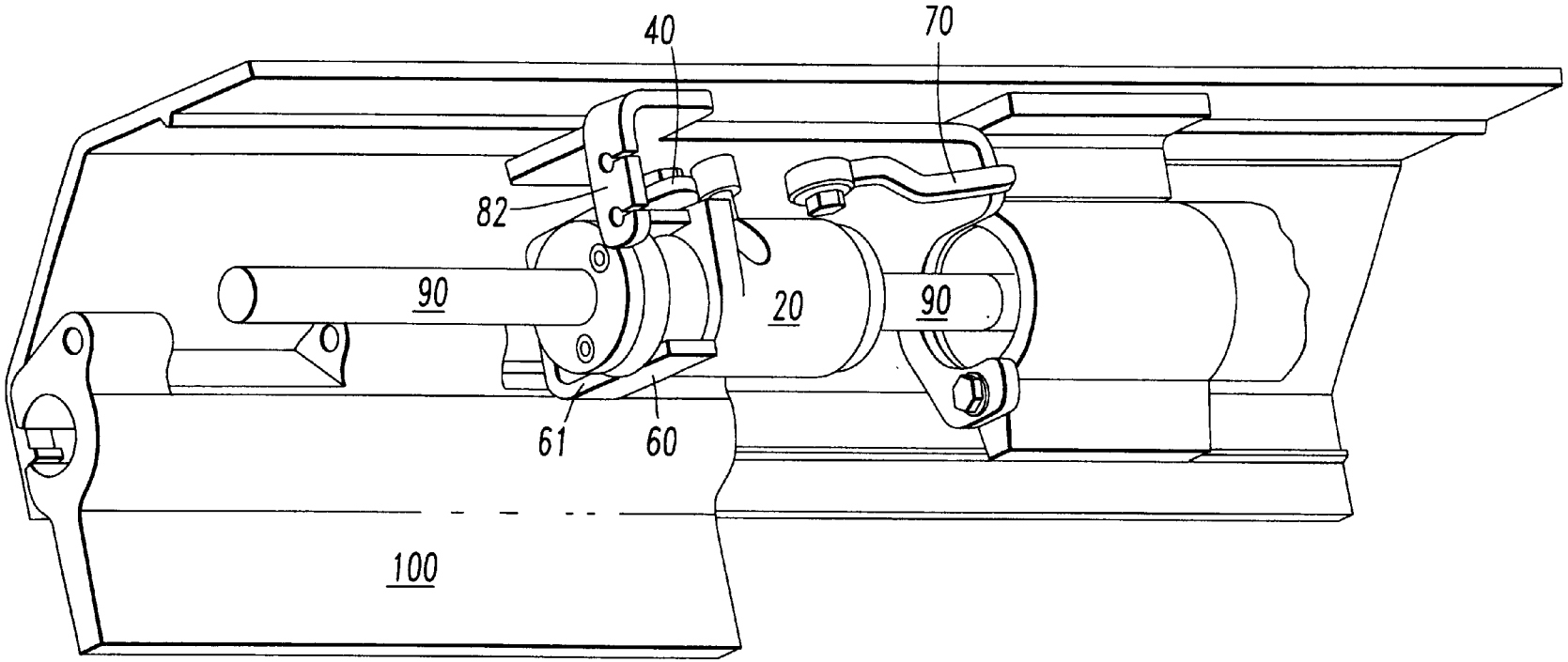
FIG. 5 is a perspective view from underneath the passenger transit type vehicle door drive which shows a manual release lever.
Figure 7:
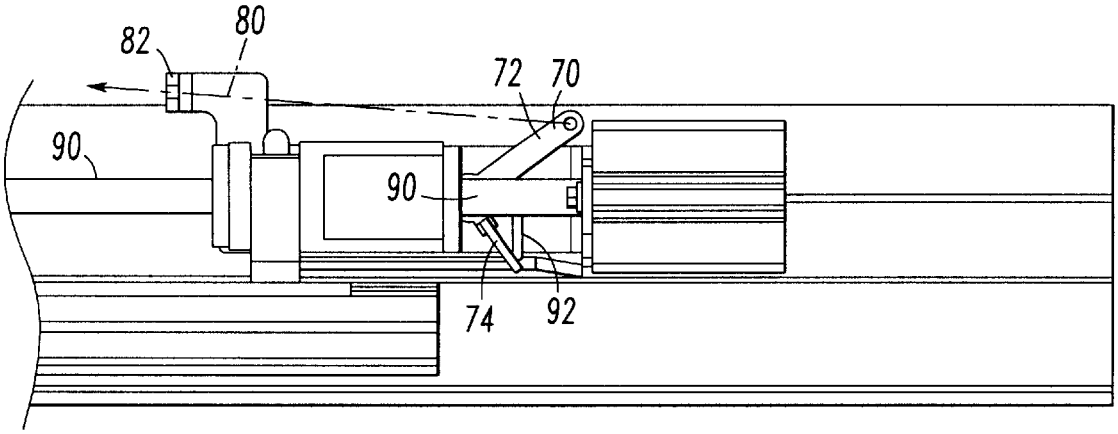
FIG. 7 is a plan view from underneath the passenger transit type vehicle door drive which shows first and second arms of the manual release lever and a pin on the drive screw which is turned by the manual release lever.
Figure 8:
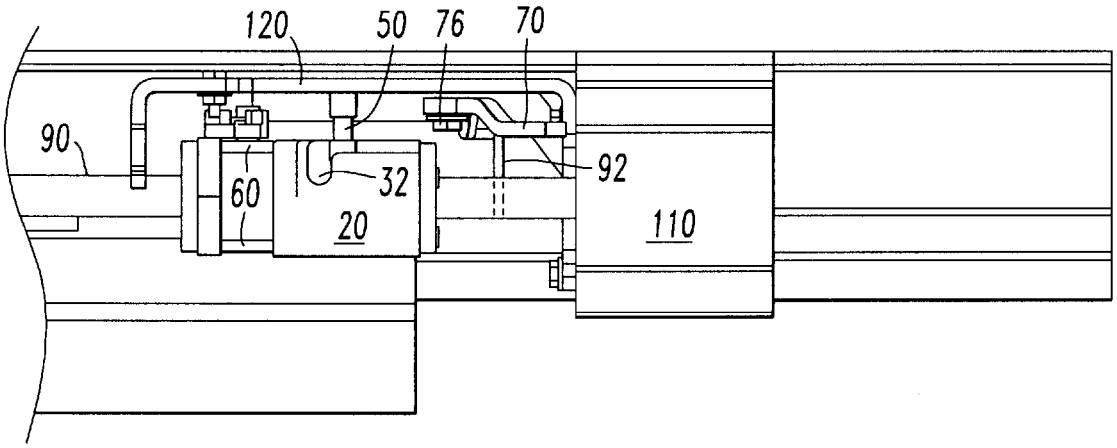
FIG. 8 is a front elevation view showing the manual release lever and the pin on the drive screw.

FIGS. 5 and 8 show the anti-rotation lever 40 in a position in which it does not prevent the rotation of such drive nut 20.

Inasmuch as the drive mechanism 10 cannot be back driven from the locked position, it is necessary for the passenger transit type vehicle door embodiment, to provide a manual release.

Structural details of the manual release mechanism are shown in FIGS. 5,6,7 and 8. A manual release lever 70 engages pin 92 on drive screw 90 to rotate drive screw 90 so that the drive nut 20 is rotated out of the locking position. Manual release lever 70 includes a first arm 72 which is moved by manual release cable 80. Such manual release lever 70 further includes a second arm 74 which contacts pin 92 on drive screw 90. It is preferred that manual release cable 80 be a sheathed cable.

A cable sheath termination tab 82 has at least one sheath termination connection 83. Preferably, there will be two manual release cables 80 provided, one for use by persons inside the transit vehicle and one for use by persons outside the transit vehicle. Their cable sheaths are terminated at the two sheath termination connections 83 shown in FIG. 6. FIG. 8 is a view from the front showing pivot 76 of manual release lever 70.

Figure 9A:
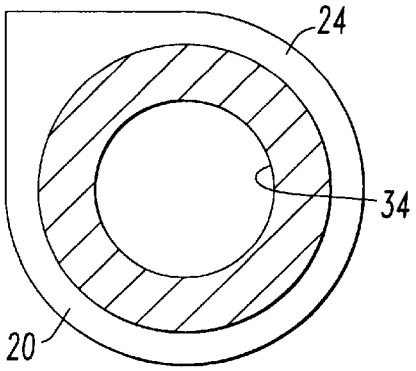
FIG. 9A is a view, partially in cross section, which is taken transverse to the axis of the drive nut.
Figure 9B:
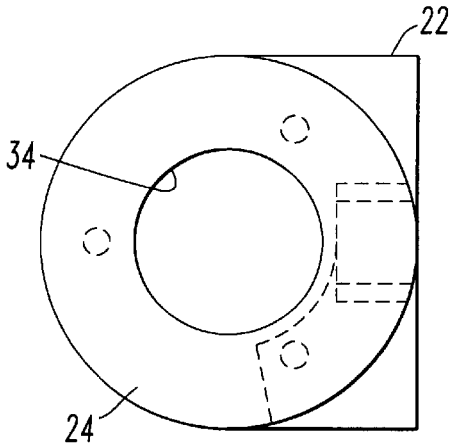
FIG. 9B is an end view of the left end of the drive nut.
Figure 9C:
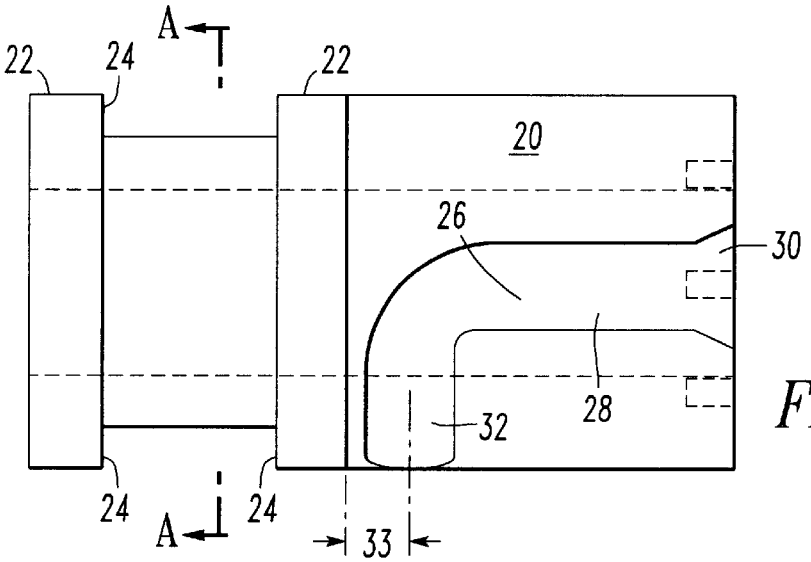
FIG. 9C is a top view of the drive nut and defines the section shown in FIG. 9A.

FIGS. 9A through 9D show a presently preferred embodiment of the drive nut 20. These figures lack end caps 36 which are present in the preceding figures. End caps 36 are not preferred. These end caps 36 were present, however, in the prototype unit even though they are not preferred. FIG. 9A shows a transverse cross section on Section A—A which is shown in FIG. 9C. FIG. 9C is a top view of the drive nut 20. FIG. 9A shows one of the drive force applying surface portions 24 which communicate a drive force to the drive force receiving surface portion 61 of drive force receiving member 60. Threaded bore 34 of drive nut 20 can be seen in this figure.

FIG. 9B is an end view illustrating the torsion surface portion 22 which engages anti-rotation lever 40 to prevent rotation of drive nut 20 when the anti-rotation lever 40 is in position to prevent rotation of the drive nut 20.

Figure 9D:
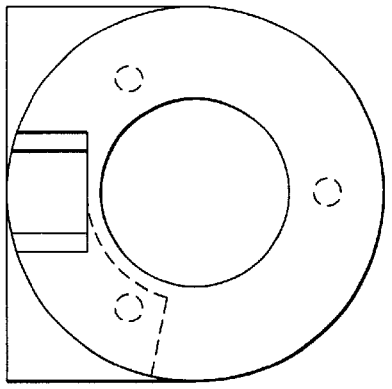
FIG. 9D is an end view from the right end of the drive nut.

Illustrated in FIG. 9C is the drive force applying surface portions 24 of the drive nut 20, as well as the torsion surface portions 22. This figure also shows the track 26, which preferably includes a flared end 30, an axial portion 28 and substantially circumferential portion 32. It is presently preferred that the substantially circumferential portion 32 have a reversed slope 33 of generally about 3 degrees, as shown in FIG. 9C. Negative slope 33 is for providing more secure locking of the door drive 10. FIG. 9d shows a view of drive nut 20 from the right end.

Figure 10:
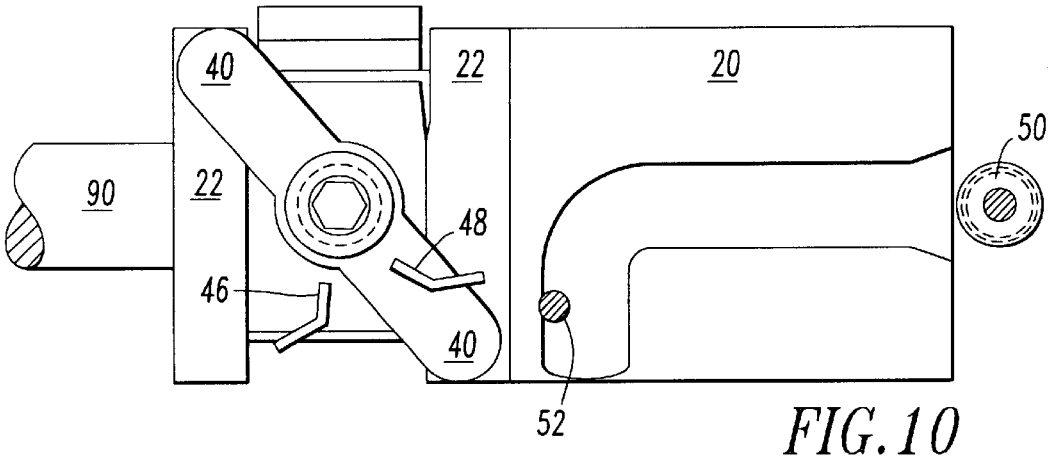
FIG. 10 is a top view showing the anti-rotation lever in position to prevent rotation of the drive nut.
Figure 12:
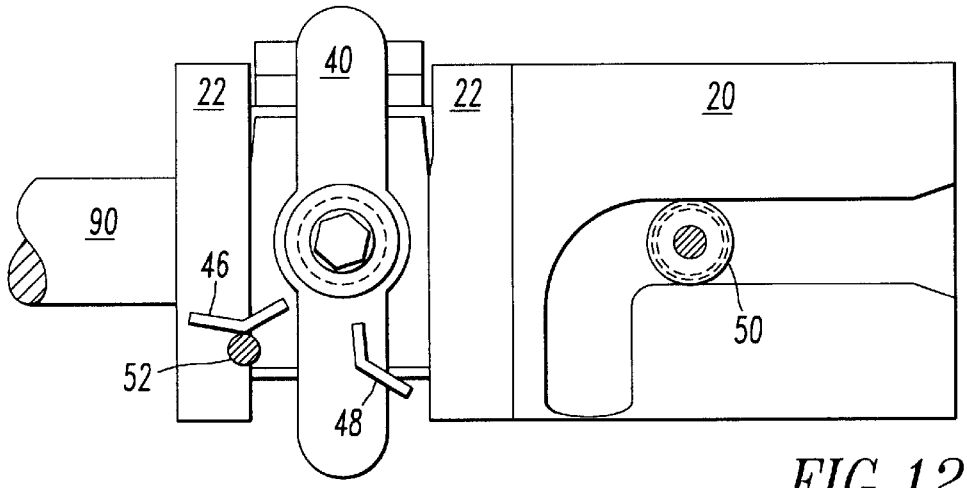
FIG. 12 is a top view showing the anti-rotation lever in the disengaging position in which it does not prevent rotation of the lock nut.
Figure 13:
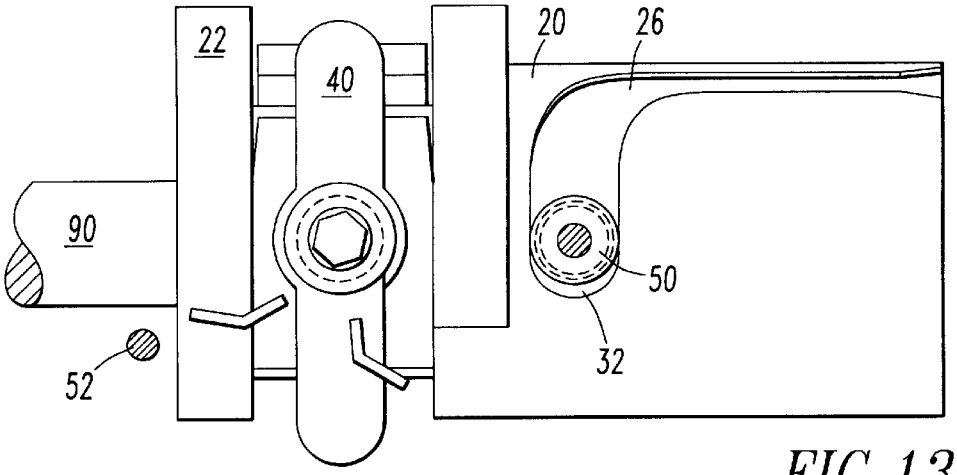
FIG. 13 is a top view showing the drive nut in a rotated position in which it locks the door.

FIGS. 10 through 15 show detail of the locking action. These figures are plan views showing the drive nut 20, the lock roller 50 and the anti-rotation lever 40. FIG. 10 shows the configuration when the door drive 10 is in an open position. An activation pin 52, which is preferably attached to cantilever 120, is shown in this figure. In FIG. 11, the drive nut 20 has been moved toward the closed position and lock roller 50 is in the axial track portion 28. In this figure, activation pin 52 has contacted disengaging surface portion 46 of anti-rotation lever 40. In FIG. 12, further motion of the drive nut 20 has caused activation pin 52 to move anti-rotation lever 40 to the transverse position shown in which it does not prevent rotation of the drive nut 20. In FIG. 13 the door drive 10 is in the locked position and drive nut 20 has rotated to the position shown in which lock roller 50 is in the substantially circumferential portion 32 of track 26.

Figure 14:
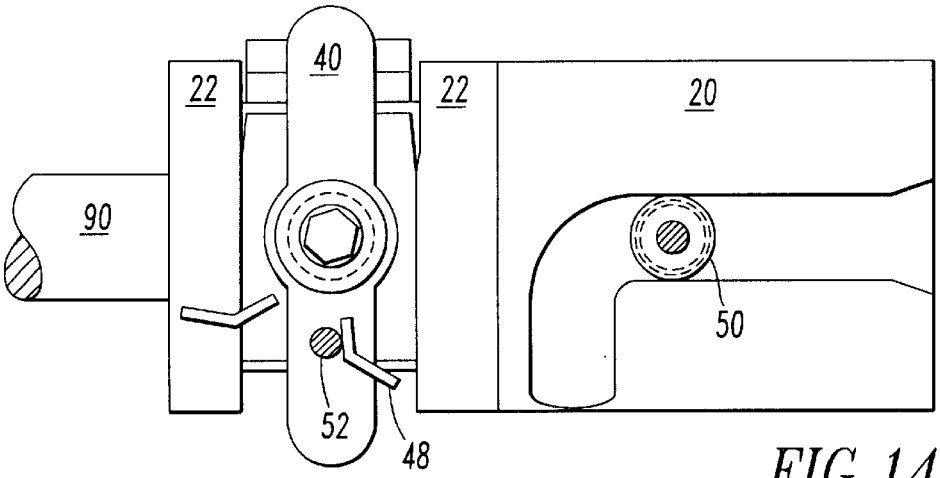
FIG. 14 is a top view showing the activation pin contacting an engaging surface portion of the anti-rotation lever to place the anti-rotation lever in a position to prevent rotation of the drive nut.
Figure 15:
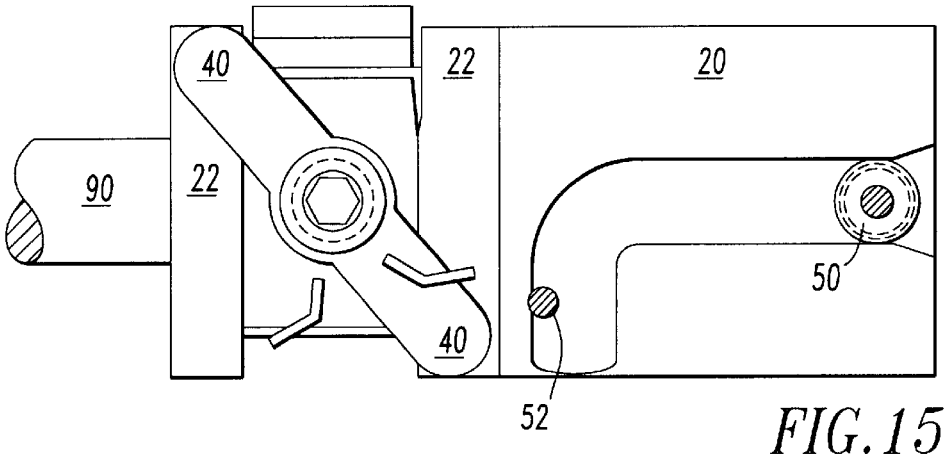
FIG. 15 is a top view showing the anti-rotation lever returned to the engaged position in which it prevents rotation of the drive nut.

FIG. 14 shows the door drive 10 being moved to the open position. Drive nut 20 has rotated and moved toward the left until activation pin 52 has contacted engaging surface portion 48 of anti-rotation lever 40. In FIG. 15, anti-rotation lever 40 has been moved to the position in which it prevents rotation of drive nut 20. In this position, further motion of drive nut 20 opens the door.

The system described above has two basic positions for the anti-rotation lever 40. One position is that shown in FIGS. 1 and 10 in which it prevents rotation of drive nut 20. The other position is that shown in FIGS. 12, 13, and 14 in which it does not prevent rotation of drive nut 20. To secure anti-rotation lever 40 in either of these two positions, a detent 44, which is seen in FIGS. 1 and 3, is provided. Detent 44, for example, may be spring mounted to push downward on a ball (not shown) which can engage one of two detent cavities 45, one of which is seen in FIG. 3. One of the cavities 45 is positioned so as to keep the anti-rotation lever 40 in the transverse position as shown in FIGS. 12, 13 and 14 in which it does not prevent rotation of drive nut 20.

Another of the cavities (not shown) is positioned so as to keep the anti-rotation lever 40 in the position shown in FIGS. 1 and 3 in which it prevents rotation of such drive nut 20.

While a presently preferred and a number of other alternative embodiments of the present invention have been described in some detail above, it should be understood that various other alternative embodiments of the invention can be envisioned by those persons who are skilled in the relevant art without departing from either the spirit of the invention or the scope of the appended claims.

I claim:

1. A screw drive mechanism connectable to a first machine portion and to a second machine portion for moving such second machine portion relative to such first machine portion from a first position to a second position, said screw drive mechanism comprising:

(a) a base member engageable with at least one of such first machine portion and such second machine portion;

(b) a motor attached to said base member;

(c) a drive screw having a rotary motion connection to said motor to be rotated thereby;

(d) a drive nut having an internally threaded bore engaged with said drive screw to receive a drive force therefrom;

(e) a drive nut connection engaged with said drive nut and engageable with such second machine portion for conveying said drive force to an opposed one of such first machine portion and such second machine portion;

(f) an anti-rotation member attached to said drive nut connection, said anti-rotation member engaging said drive nut to prevent rotation of said drive nut;

(g) an activation member attached to said base, said activation member contacting a disengaging surface portion of said anti-rotation member when such opposed one of such first machine portion and such second machine portion is moved to such second position to place said anti-rotation member in a position that is disengaged from said drive nut so that said drive nut may rotate; and (h) a drive nut rotating device attached to said base member, said drive nut rotating device including a roller having an axis substantially perpendicular to said drive screw, said drive nut including a track for engaging said roller to rotate said drive nut to a locking position when such opposed one of such first machine portion and such second machine portion is moved to such second position.

2. A screw drive mechanism, according to claim 1, wherein said track includes a portion disposed substantially parallel to said drive screw and a substantially circumferential portion.

3. A screw drive mechanism, according to claim 2, wherein said track is a groove.

4. A screw drive mechanism, according to claim 3, wherein said groove includes a flared end portion to facilitate engagement of said roller and said groove.

5. A screw drive mechanism, according to claim 2, wherein said substantially circumferential portion includes a small reverse lead.

6. A screw drive mechanism, according to claim 5, wherein said small reverse lead is generally about 3 degrees.

7. A screw drive mechanism, according to claim 1, wherein said drive nut has at least one torsion surface portion for engaging said anti-rotation member.

8. A screw drive mechanism, according to claim 1, wherein said anti-rotation member is a lever pivotally attached to said drive nut connection.

9. A screw drive mechanism, according to claim 1, wherein said activation member is an activation pin.

10. A screw drive mechanism, according to claim 1, wherein said activation member contacts an engaging surface portion of said anti-rotation member when said opposed one of such first machine portion and such second machine portion is moved out of said second position so that it engages said drive nut so that said drive nut is prevented from rotating whereby rotation of said drive screw moves said opposed one of such first machine portion and such second machine portion to said first position.

11. A screw drive mechanism for a door of a passenger transit type vehicle for moving such door from an open position to a closed position, said screw drive mechanism comprising:

(a) a base member engageable with such passenger transit type vehicle;

(b) a motor attached to said base member;

(c) a drive screw having a rotary motion connection to said motor to be rotated thereby;

(d) a drive nut having an internally threaded bore engaged with said drive screw to receive a drive force therefrom;

(e) a drive nut connection engaged with said drive nut and engageable with such door to convey said drive force to such door;

(f) an anti-rotation member attached to said drive nut connection, said anti-rotation member engaging said drive nut to prevent rotation of said drive nut;

(g) an activation member attached to said base member, said activation member contacting a disengaging surface portion of said anti-rotation member when such door is moved to such closed position to place said anti-rotation member in a position disengaged from said drive nut so that said drive nut may rotate; and (h) a drive nut rotating device attached to said base member, said drive nut rotating device including a roller having an axis substantially perpendicular to said drive screw, said drive nut including a track for engaging said roller to rotate said drive nut to a locking position when such door is moved to such closed position.

12. A screw drive mechanism for a door of a passenger transit type vehicle, according to claim 11, wherein said screw drive mechanism further includes a door hanger attached to said drive nut connection, said door hanger for attachment of such door.

13. A screw drive mechanism for a, door of a passenger transit type vehicle, according to claim 11, wherein said screw drive mechanism further includes at least one manual release mechanism for rotating said drive screw to rotate drive nut out of said locking position so that such door may be opened manually.

14. A screw drive mechanism for a door of a passenger transit type vehicle, according to claim 13, wherein said manual release mechanism includes a manual release lever and said drive screw mechanism further includes a pin substantially orthogonal to said drive screw to be engaged by said manual release lever to rotate said drive screw.

15. A screw drive mechanism for a, door of a passenger transit type vehicle, according to claim 14, wherein said manual release mechanism further includes a cable attached to said manual release lever to rotate said manual release lever to rotate said drive screw.

16. A screw drive mechanism for a door of a passenger transit type vehicle, according to claim 14, wherein said manual release mechanism further includes two cables attached to said manual release lever to rotate said manual release lever, a first one of said two cables for use by persons inside said transit vehicle, and a second one of said two cables for use by rescue personnel outside said transit vehicle.

17. A screw drive mechanism for a door,of a passenger transit type vehicle, according to claim 13, wherein said at least one manual release mechanism includes two manual release levers, one for activation by persons inside such transit vehicle and one for activation by rescue personnel outside such transit vehicle.

18. A screw drive mechanism for a door of a passenger transit type vehicle, according to claim 11 wherein said substantially circumferential portion has a small reverse lead so that an attempt to force such door to said open position forces said drive nut more firmly into said locking position.

19. A screw drive mechanism for door of a passenger transit type vehicle, according to claim 11, wherein said small reverse lead is generally about 3 degrees.

20. A screw drive mechanism for a door of a passenger transit type vehicle, according to claim 11, wherein said activation member contacts an engaging surface portion of said anti-rotation member when such door is moved out of said closed position so that said anti-rotation member engages said drive nut so that said drive nut is prevented from rotating whereby rotation of said drive screw moves such door to said open position.

* * * * *